US012773605B2

(12) United States Patent
LaCroix

(10) Patent No.: US 12,773,605 B2
(45) Date of Patent: Oct. 27, 2026

(54) CROQUET MALLET WITH ADJUSTABLE WEIGHT AND LENGTH

(71) Applicant: Gilbert LaCroix, Naples, FL (US)

(72) Inventor: Gilbert LaCroix, Naples, FL (US)

( * ) Notice: Subject to any disclaimer, the term of this patent is extended or adjusted under 35 U.S.C. 154(b) by 0 days.

(21) Appl. No.: 19/281,958

(22) Filed: Jul. 28, 2025

(65) Prior Publication Data

US 2026/0034419 A1 Feb. 5, 2026

Related U.S. Application Data

(60) Provisional application No. 63/677,806, filed on Jul. 31, 2024.

(51) Int. Cl.
*A63B 60/04* (2015.01)
*A63B 59/60* (2015.01)

(52) U.S. Cl.
CPC ..... *A63B 60/04* (2015.10); *A63B 59/60* (2015.10)

(58) Field of Classification Search
CPC ..... A63B 60/04; A63B 59/60
See application file for complete search history.

(56) References Cited

U.S. PATENT DOCUMENTS 3,909,005 A * 9/1975 Piszel ..... A63B 53/007 473/336
4,828,266 A * 5/1989 Tunstall ..... A63B 53/0487 473/336
5,224,210 A * 6/1993 Pinedo ..... G09G 5/14 345/506
5,244,210 A * 9/1993 Au ..... A63B 53/0487 473/336
5,571,053 A * 11/1996 Lane ..... A63B 53/065 473/340
6,450,894 B1 * 9/2002 Sun ..... A63B 60/02 473/341
8,206,234 B1 * 6/2012 Slater ..... A63B 53/04 473/340
10,052,533 B1 * 8/2018 Kuc ..... A63B 53/0466
2020/0197767 A1 * 6/2020 Morelock ..... A63B 53/007
2023/0347214 A1 * 11/2023 Cornelius ..... A63B 60/04

* cited by examiner

*Primary Examiner* — Joseph B Baldori
*Assistant Examiner* — Christopher Glenn

(57) ABSTRACT

A modular croquet mallet system, referred to as SwingW8, enables players to customize mallet weight and length to suit individual preferences and playing style. The system includes a mallet head with one or more modular enclosures (Pod Pockets) attachable to each end, each configured to hold one or more weight modules (W8pods) of uniform outer size but variable internal mass for incremental swing weight adjustment. The Pod Pockets also define overall mallet length, allowing quick configuration to variable lengths, including but not limited to 10", 11", and 12" sizes. End Caps secure the Pod Pockets to the mallet head and provide finished striking faces. By selecting and combining W8pods, a player can quickly fine-tune balance and performance while maintaining symmetry and structural integrity. This modular design permits reversible weight and length changes without permanent modification, supporting consistent pendulum-style swings as player skills or preferences evolve.

12 Claims, 4 Drawing Sheets

REFERENCE NUMERALS

Mallet Head 100
Threaded Inserts 101
Handle Bore 102
Mallet Head Sight Line 103
Pod Pocket 120
Internal Opening 121
Inspection Port 122
Pod Pocket Sight Line 123
W8pods 130
End Caps 140
Fasteners 150

REFERENCE NUMERALS

Mallet Head 100
Threaded Inserts 101
Handle Bore 102
Mallet Head Sight Line 103
Pod Pocket 120
Internal Opening 121
Inspection Port 122
Pod Pocket Sight Line 123
W8pods 130
End Caps 140
Fasteners 150

REFERENCE NUMERALS

Mallet Head 100
Threaded Inserts 101
Handle Bore 102
Mallet Head Sight Line 103
Pod Pocket 120
Internal Opening 121
Inspection Port 122
Pod Pocket Sight Line 123
W8pods 130
End Caps 140
Fasteners 150

REFERENCE NUMERALS

Mallet Head 100
Threaded Inserts 101
Handle Bore 102
Mallet Head Sight Line 103
Pod Pocket 120
Internal Opening 121
Inspection Port 122
Pod Pocket Sight Line 123
W8pods 130
End Caps 140
Fasteners 150

REFERENCE NUMERALS

Mallet Head 100
Threaded Inserts 101
Handle Bore 102
Mallet Head Sight Line 103
Pod Pocket 120
Internal Opening 121
Inspection Port 122
Pod Pocket Sight Line 123
W8pods 130
End Caps 140
Fasteners 150

CROQUET MALLET WITH ADJUSTABLE WEIGHT AND LENGTH

CROSS-REFERENCE TO RELATED APPLICATIONS

This application claims priority under 35 U.S.C. § 119(e) to U.S. Provisional Patent Application No. 63/677,806, filed Jul. 31, 2024, the entire contents of which are incorporated herein by reference.

FIELD

The present invention relates generally to croquet equipment, and more particularly to a modular croquet mallet system that employs weight-adjustment assemblies (Pod Pockets) secured to each end of a mallet head and housing interchangeable weight modules (W8pods). The Pod Pockets allow a player to reversibly adjust overall mallet weight distribution and, by selecting different combinations and/or numbers of Pod Pockets and W8pods, to vary the mallet's overall length and total weight to suit individual swing characteristics and playing conditions.

BACKGROUND

Croquet mallets used in tournament and recreational play are typically constructed with a fixed head, fixed length, and a uniform weight that cannot be adjusted by the player. While some manufacturers offer custom-weighted mallets at the time of purchase, players buying a mallet for the first time often do not know their ideal weight. Once a mallet is manufactured to a specified weight, it is difficult, expensive, or in many cases impossible to change that weight as the player develops their skills or preferences.

Achieving a smooth, controlled pendulum swing-a motion unique to croquet, where the mallet is swung between the player's legs-is crucial for accurate shot-making. Each player has individual weight and balance requirements to achieve stability, avoid a wobbling swing, and generate optimal power suited to their physique. Existing mallet designs typically concentrate weight uniformly along the head, offering no simple way to adjust the distribution or the moment of inertia to improve control and reduce mishits.

Length is another factor affecting swing mechanics and comfort. Most croquet mallets are manufactured to standard 10", 11", or 12" lengths, requiring a player to commit to a single fixed length. Players who wish to experiment with different lengths to find their optimal setup often must either purchase multiple mallets or otherwise gain access to different sizes for testing, an impractical and costly approach.

There is therefore a need for a croquet mallet system that allows for simple, reversible, and precise customization of both mallet weight and length, without requiring multiple mallets or permanent modifications. Such a system should allow players to quickly configure the mallet to suit their desired swing feel and performance, while maintaining structural integrity and durability.

SUMMARY

The present invention provides a modular croquet mallet system, referred to herein as SwingW8, that enables players to adjust both the weight and length of the mallet to suit individual preferences and playing conditions. The system utilizes modular interchangeable enclosures (Pod Pockets), which are attachable to each end of the mallet head. Each Pod Pocket is configured to receive and retain one or more weight modules (W8pods), each of which has a uniform external size but a variable internal mass, enabling incremental and reversible adjustments to the mallet's overall swing weight.

The Pod Pockets also contribute to the overall length of the mallet, allowing the player to configure the mallet to variable lengths, including the standard lengths of 10", 11", or 12", without requiring multiple mallets. End Caps are secured to the outward-facing ends of the Pod Pockets, both enclosing the W8pods and providing a durable striking surface.

This modular system allows a player to experiment with and fine-tune their mallet configuration quickly and reversibly, avoiding the need for multiple fixed-weight mallets or permanent alterations. The invention maintains the strength and stability required for consistent pendulum-style swings while giving players the ability to optimize performance over time as their skills or preferences evolve. Each Pod Pocket may include an inspection port or window that exposes at least one W8pod, allowing players and officials to verify color-coded weight selection at a glance. The exterior surface of the Pod Pocket can further incorporate a contrasting longitudinal sight-line indicator aligned with the striking axis of the mallet to aid aiming accuracy.

Terminology

Figure 1:
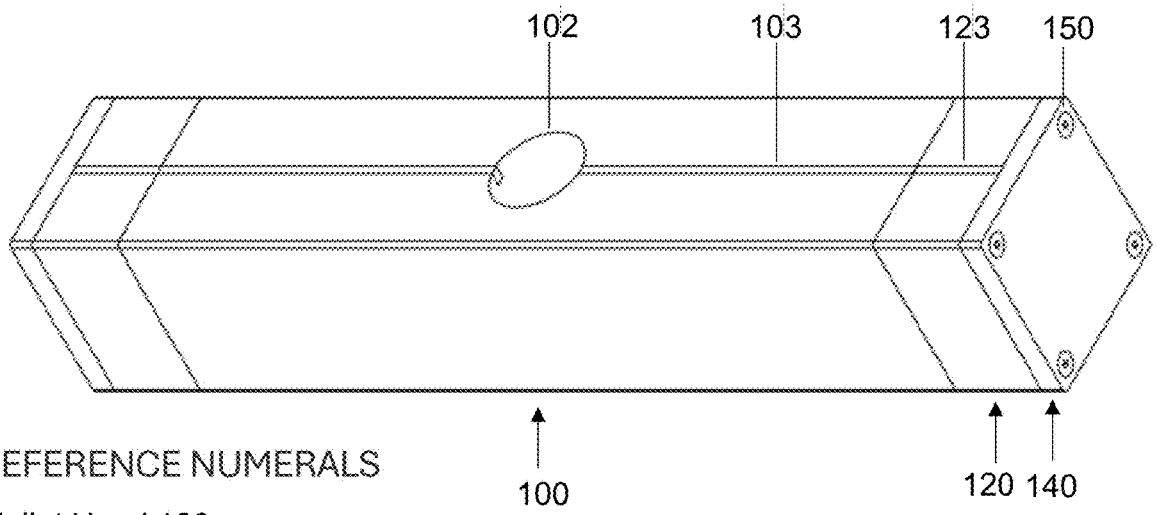
FIG. 1 is a top front perspective view of the assembled SwingW8 modular croquet mallet, showing the Mallet Head 100, Handle Bore 102, optional Sight Line 103, Pod Pockets 120 with optional Sight Lines 123, End Caps 140, and Fasteners 150.
Figure 2:
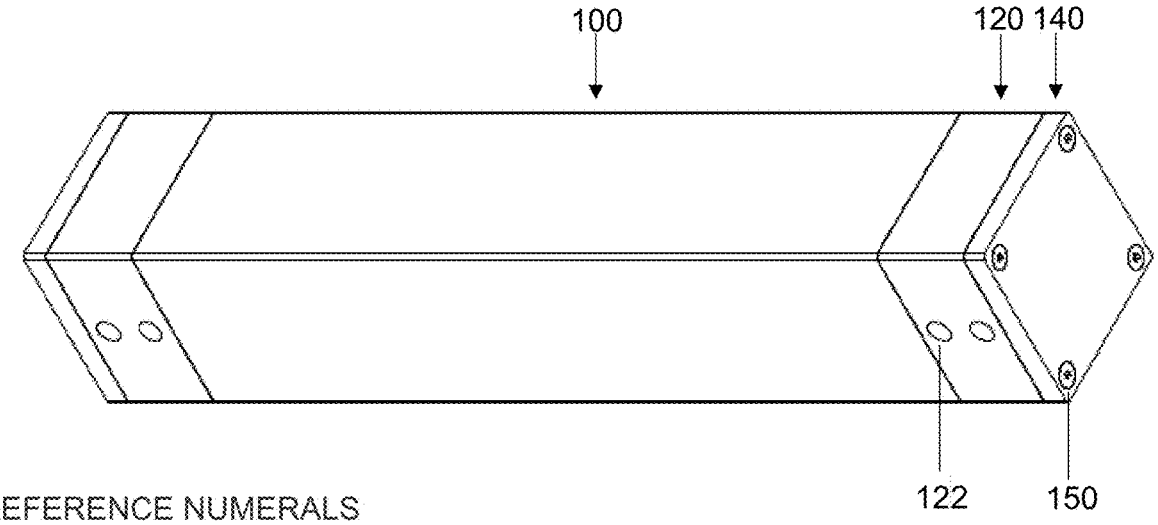
FIG. 2 is a bottom front perspective view of the assembled mallet, showing the Mallet Head 100, Pod Pockets 120 with optional Inspection Ports 122, End Caps 140, and Fasteners 150.

As used herein:

SwingW8 refers to the modular croquet mallet system that enables a player to customize mallet weight and length. The "W8" portion of the name is a stylized abbreviation for "weight."

W8pod 130 refers to a modular weight insert of uniform external dimensions but variable internal mass, configured to be removably received within a Pod Pocket 120. The "W8" designation in "W8pod" similarly reflects its role as a weight element. Unless explicitly stated otherwise, all weights (e.g., 0 oz, 1 oz, 2 oz, etc.) are nominal or approximate values, with the "0 oz" module being a baseline unit that has mass, and each heavier module being approximately the stated amount heavier than the baseline.

Pod Pocket 120 refers to a structural module attachable to each end of the mallet head 100, designed to house one or more W8pods 130 and contribute to mallet length.

About or approximately refer to values that may vary by +10% to account for normal manufacturing tolerances, unless expressly stated otherwise.

DETAILED DESCRIPTION OF THE DRAWINGS

Referring to the drawings, wherein like reference characters designate identical or corresponding parts throughout the several views, a modular croquet mallet system 10 (commercially known as SwingW8) is shown and described.

Mallet Head 100 (100 Series)

Figure 3:
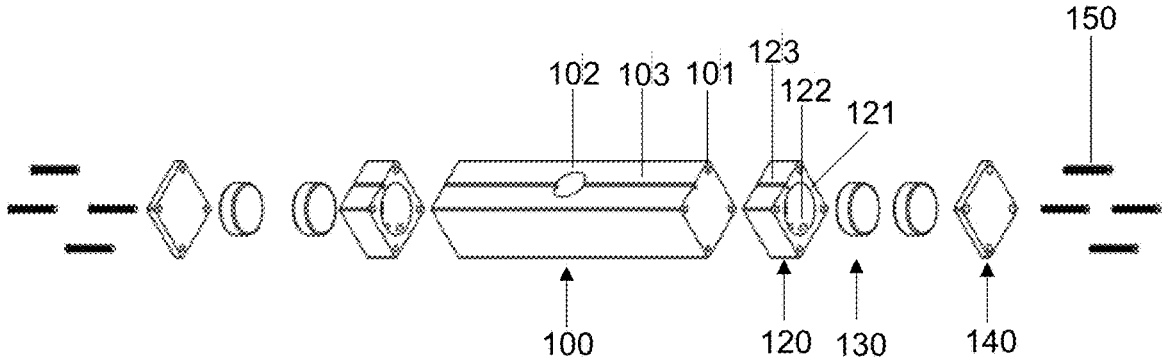
FIG. 3 is a top front perspective exploded view of the mallet, showing the Mallet Head 100 with Threaded Inserts 101, Handle Bore 102, optional Sight Line 103, Pod Pockets 120 with Internal Openings 121, optional Inspection Ports 122, and optional Sight Lines 123, W8pods 130, End Caps 140, and Fasteners 150.
Figure 4:
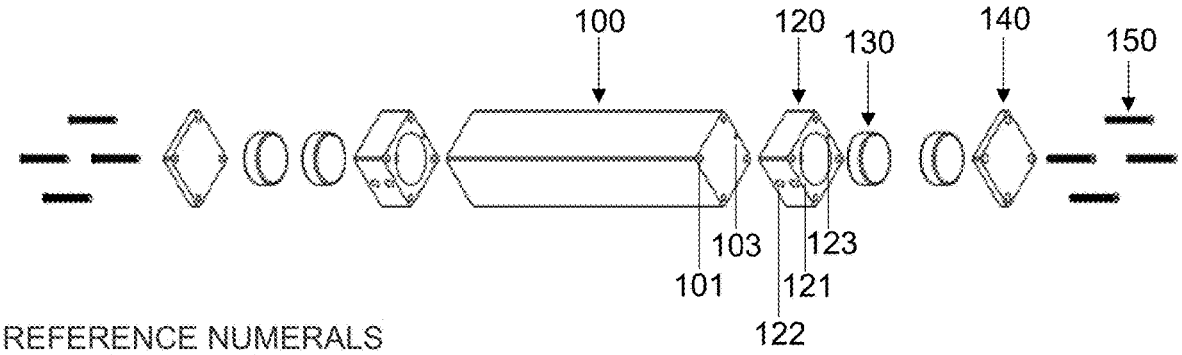
FIG. 4 is a bottom front perspective exploded view of the mallet, showing the Mallet Head 100 with Threaded Inserts 101 and optional Sight Line 103, Pod Pockets 120 with Internal Openings 121, optional Inspection Ports 122, optional Sight Lines 123, W8pods 130, End Caps 140, and Fasteners 150.

The system centers on a mallet head 100 sized and shaped for regulation croquet play. The mallet head 100 may be round, square, rectangular, or any other geometry permitted for regulation play, allowing for user preference and customization. Four threaded inserts 101 (e.g., ¼-20 brass, stainless steel, or polymer) are permanently embedded at each axial end of the mallet head 100. These inserts provide robust, repeatable attachment points for auxiliary components without compromising structural integrity. For clarity, the threaded inserts 101 are not visible in FIG. 1 but are depicted in FIGS. 3 and 4.

A handle bore 102 extends vertically into, but not necessarily through, the mallet head 100 to receive any standard croquet-handle spigot (e.g., Oakley™, Wood, or equivalent). The bore may be sleeved, keyed, or threaded to accept commercially available or custom handles.

Optionally, a longitudinal mallet-head sight line 103-painted, laser-engraved, inlaid, or molded in contrasting material-runs along the striking axis to assist a player in aligning shots. The presence, position, and color of this sight line 103 are user-selectable and not essential to the modular functionality.

Materials. The mallet head 100 may be constructed from machined aluminum, molded or 3D-printed polymers (ASA, TPU, nylon, etc.), wood, composite laminates, or any combination thereof, provided the structure is strong and durable enough to withstand regulation play.

2. Pod Pockets 120 (120 Series)

Each axial end of the mallet head 100 may receive one or more Pod Pockets 120. A standard Pod Pocket 120 is a generally cylindrical or prismatic module whose internal opening 121 forms a precisely machined cavity for stacking interchangeable weight modules (W8pods 130, below). The exterior dimensions of each Pod Pocket 120 should generally match, but do not necessarily have to match, the overall shape of the mallet head 100 to maintain a cohesive profile. In the illustrated embodiment shown in FIGS. 3 and 4, each Pod Pocket 120 is an extended-depth version sized to receive two W8pods 130 arranged end-to-end, yielding an overall mallet length of approximately 11 inches-comprising an 8.5-inch mallet head 100, two 1-inch Pod Pockets 120, and two 0.25-inch End Caps 140.

The internal opening 121 is dimensioned to correspond closely with the outer size and shape of the W8pods 130, ensuring that the weight modules fit securely while still being easily inserted and removed as needed. Minor tolerances may be included to allow smooth stacking and to accommodate variations in materials or manufacturing processes.

To identify the size and arrangement of the enclosed W8pods 130, a visual inspection port 122 may be provided on the bottom of the Pod Pocket 120. The port can be open, windowed with a transparent polymer, or omitted entirely if weight visibility is unnecessary.

An optional pod pocket sight line 123 may be located on the top of each Pod Pocket 120 to provide a continuous aiming line across multiple stacked components.

Pod-Pocket Modularity

- Length. The axial depth of internal opening 121 is preferably an integer multiple of the depth of one W8pod 130, yet undersized or oversized cavities may be used when a spacer or shim is fitted.
- Stacking. Any number of Pod Pockets 120 may be stacked in series at either end of the mallet head 100 to produce overall mallet lengths of 10 in, 11 in, 12 in, or other custom dimensions, while preserving end-to-end symmetry.

Materials. Pod Pockets 120 may be machined from aluminum, molded or 3D-printed polymers (e.g., ASA, TPU, nylon), wood, composite laminates, or any combination thereof, provided the chosen material delivers sufficient strength for normal play.

3. W8pods 130 (130 Series)

W8pods 130 are interchangeable weight modules used to adjust the overall weight and balance of the modular croquet mallet system 10. Each W8pod 130 has uniform external dimensions that correspond to the internal opening 121 of the Pod Pocket 120, ensuring a secure yet easily removable fit.

The W8pods 130 may be disc-shaped or otherwise conformal to the shape of the internal opening 121, and are manufactured in nominal or approximate graded weights (e.g., a baseline "0 oz" module, which itself has mass, and additional modules approximately 1 oz, 2 oz, 3 oz, or 4 oz heavier than the baseline module). A player customizes the mallet's total head weight- and, consequently, its moment of inertia-by selecting and stacking different combinations of W8pods 130 inside the Pod Pocket 120.

For rapid identification, the W8pods 130 may employ color coding, engraving, or RFID tagging, though such identification is optional and not required for normal use.

Materials. W8pods 130 may be constructed from 3D-printed polymers (e.g., ASA, TPU, nylon), metallic masses such as lead, steel, or tungsten, composite laminates, or any combination thereof, provided they are safely enclosed and suitable for regulation play.

4. End Caps 140 (140 Series)

Each End Cap 140 is a removable component that closes the stack of Pod Pockets 120 at each axial end of the mallet head 100, providing additional weight, a tactile and acoustic signature, and preventing ejection of W8pods 130 during play. The exterior dimensions of each End Cap 140 generally match, but do not necessarily have to match, the overall shape of the mallet head 100 to maintain a cohesive profile.

An End Cap 140 may incorporate an internal recess designed to hold an auxiliary W8pod 130 or a vibration-damping insert to fine-tune the mallet's feel and balance. Each End Cap 140 is secured in place by Fasteners 150 that engage the threaded inserts 101 within the mallet head 100.

Materials. End Caps 140 may be constructed from machined aluminum, molded or 3D-printed polymers (ASA, TPU, nylon, etc.), hardwoods, engineered composites, metallic alloys (e.g., brass, steel), or any combination thereof, provided the material(s) deliver sufficient durability for regulation play. Hollow or solid constructions can be selected to tune weight distribution, vibration damping, and audible feedback.

5. Fasteners 150 (150 Series)

The Fasteners 150 secure all modular components-including the Pod Pockets 120 and End Caps 140-to the threaded inserts 101 embedded in the mallet head 100. The length of each Fastener 150 is selected so that it is sufficient to securely fasten the cumulative stack of Pod Pockets 120 and End Caps 140 to the mallet head 100, with the specific length varying based on the number and type of components used, without limitation to predetermined mallet lengths.

Assembly & Use

To configure the modular croquet mallet system 10, a player selects the desired overall mallet length and weight by combining the necessary Pod Pockets 120, End Caps 140, and W8pods 130 at each axial end of the mallet head 100. The Pod Pockets 120 and End Caps 140 collectively determine the mallet's final length (e.g., 10 inches, 11 inches, 12 inches, or other user-selected dimensions), while the selected W8pods 130 and End Caps 140 establish the desired weight and moment of inertia.

The assembled components are secured to the mallet head 100 by the Fasteners 150, which engage the threaded inserts 101 to ensure a rigid and repeatable connection. An optional visual inspection port 122 in each Pod Pocket 120 allows the player to confirm the size and arrangement of the enclosed W8pods 130, and an optional pod pocket sight line 123, aligned with any mallet-head sight line 103, provides a continuous aiming reference across the assembled structure.

A handle is then inserted into the handle bore 102, completing the mallet assembly. By replicating the same configuration at both ends, the player maintains perfect axial symmetry, ensuring a balanced, pendulum-like swing during play.

ALTERNATE EMBODIMENTS

In addition to the configurations described above, the modular croquet mallet system 10 may incorporate a variety of alternate arrangements and features.

In one embodiment, a non-symmetrical training configuration may be used in which weight is intentionally offset between the two ends of the mallet head 100. While tournament play generally requires symmetry, this configuration allows coaches or players to emphasize swing path corrections and improve stroke mechanics by exaggerating swing imbalances.

In another embodiment, a W8pod 130-sized cavity within a Pod Pocket 120 or End Cap 140 may house electronic components such as accelerometers, gyroscopes, or wireless transmitters (e.g., Bluetooth®) to provide swing analytics or training feedback without altering the external geometry of the mallet.

In a further embodiment, the threaded engagement of the Fasteners 150 with the threaded inserts 101 may be replaced with alternative attachment systems, such as cam-lock studs, quarter-turn bayonets, or other quick-release couplers, to allow faster on-court adjustments without tools.

Additionally, while the preferred embodiment uses a single End Cap 140 per end, multiple End Caps 140 may be stacked in series to further extend mallet length or adjust weight distribution, provided the assembly remains balanced about the centerline of the mallet head 100.

These alternate configurations may also employ variations in materials, dimensions, or component shapes (for example, differing Pod Pocket 120 or End Cap 140 profiles, or alternate W8pod 130 mass ranges), so long as the resulting assembly maintains sufficient strength, balance, and functionality for regulation play.

REFERENCE NUMERALS (WRITTEN DESCRIPTION)

Mallet head 100—The central body of the mallet to which pod pockets 120, End caps 140, and a handle (via Handle bore 102) are attached.

Threaded inserts 101—Secured within the Mallet head 100 to receive Fasteners 150.

Handle bore 102—Opening in the Mallet head 100 for receiving a handle.

Mallet head sight line 103—Visual alignment aid on the top surface of the Mallet head 100.

Pod pocket 120—Modular component mounted to each end of the Mallet head 100 for housing W8pods 130.

Internal opening 121—Cavity within each Pod pocket 120 designed to hold W8pods 130.

Inspection port 122—Access or viewing port in each Pod pocket 120 to confirm W8pod 130 size and placement.

Pod pocket sight line 123—Visual alignment aid on each Pod pocket 120.

W8pods 130—Interchangeable weight modules used to adjust the mallet's overall weight.

End caps 140—Protective end components secured to each Pod pocket 120.

Fasteners 150—Screws or bolts used to secure pod pockets 120 and End caps 140 to the Mallet head 100.

DISCLAIMER OF UNCLAIMED SUBJECT MATTER

Except as expressly set forth herein, no aspect of the mallet head or handle, per se, is claimed as novel. Novelty is asserted only in the modular interfaces-namely the threaded inserts embedded in the mallet head and the cooperative attachment geometry of the Pod Pockets, W8pods, and End Caps-that enable length- and weight-adjustable assembly as described.

The invention claimed is:

1. A modular croquet mallet system comprising:

a mallet head defining a central body with attachment points at opposing most-distal surfaces of the mallet head;

a pair of removable end enclosures ("End Caps") attachable to the mallet head at the opposing most-distal surfaces, each End Cap providing a striking surface;

a plurality of interchangeable weight modules ("W8pods"), each having uniform external dimensions and a variable internal mass; and one or more enclosures ("Pod Pockets") removably positioned between the most-distal surfaces of the mallet head and the End Caps, each Pod Pocket configured to receive one or more W8pods, the W8pods being retained within the Pod Pockets by the End Caps;

wherein a combination of Pod Pockets and End Caps defines an overall length of the mallet, thereby enabling the mallet length to be adjusted in discrete increments without permanent modification of the mallet head or End Caps; and wherein by populating the Pod Pockets with different W8pods having uniform external dimensions but differing mass, a total weight and balance of the mallet are selectively adjustable.

2. The system of claim 1, wherein an internal cavity of each Pod Pocket is sized to receive W8pods having uniform external dimensions; and wherein the internal cavity has a length corresponding to an integer multiple of an individual W8pod thickness, thereby enabling stacked configurations without spacers or filler material.

3. The system of claim 1, wherein each W8pod has uniform external dimensions regardless of mass; and wherein the uniform external dimensions enable interchangeability within the Pod Pockets.

4. The system of claim 1, wherein multiple Pod Pockets are positionable in series between the mallet head and the End Caps on each end of the mallet head; and wherein the overall length and weight capacity of the mallet are determined by the number of Pod Pockets and the W8pods contained therein.

5. The system of claim 1, wherein each End Cap includes attachment points that, when fastened to the mallet head, secure the corresponding Pod Pocket and any W8pods contained therein; and wherein each End Cap thereby both provides a striking surface and retains the modular weight and length-adjustment system in place.

6. The system of claim 1, wherein each Pod Pocket includes a plurality of inspection ports, each inspection port corresponding to a respective W8pod received within the internal cavity; and wherein each inspection port is sized to display a color-coded portion of the respective W8pod.

7. The system of claim 1, wherein the Pod Pockets and End Caps are secured to the mallet head by removable fasteners; and wherein the removable fasteners engage threaded or recessed attachment points on the mallet head.

8. The system of claim 1, wherein each W8pod includes a coded marking that identifies the weight of the W8pod, the coded marking including color-coding; and wherein the coded marking is viewable through a plurality of inspection ports, each inspection port corresponding to a respective W8pod received within the internal cavity.

9. A modular weight-adjustment assembly for a croquet mallet, comprising:

one or more enclosures ("Pod Pockets"), each Pod Pocket defining an internal cavity configured to receive one or more interchangeable weight modules ("W8pods"), each W8pod having uniform external dimensions and a variable internal mass;

one or more removable end enclosures ("End Caps") attachable to the Pod Pockets, each End Cap providing a striking surface and cooperating with a corresponding Pod Pocket to close the internal cavity and retain any W8pods positioned therein;

wherein each Pod Pocket includes a first attachment interface configured for removable engagement with a mallet head or with a second Pod Pocket, and a second attachment interface configured for removable engagement with an End Cap or with the first attachment interface of the second Pod Pocket; and wherein a combination of Pod Pockets and End Caps defines an overall axial length of the mallet such that the mallet length is adjustable in discrete increments without permanent modification of the mallet head, Pod Pockets, or End Caps, and wherein, by selectively populating the Pod Pockets with different W8pods having uniform external dimensions but differing mass, the total weight, weight distribution, and moment of inertia of the mallet are selectively adjustable.

10. The assembly of claim 9, wherein an internal cavity of each Pod Pocket is sized to receive W8pods having uniform external dimensions; and wherein the internal cavity has a length corresponding to an integer multiple of an individual W8pod thickness, thereby enabling stacked configurations without spacers or filler material.

11. The assembly of claim 9, wherein each W8pod is color-coded according to mass; and wherein the Pod Pocket includes a plurality of inspection ports, each inspection port corresponding to a respective W8pod received within the internal cavity, each inspection port being sized to display the color-coding of the W8pod when installed.

12. The assembly of claim 9, wherein the Pod Pocket includes a longitudinal sight-line indicator that contrasts in color or texture with an exterior surface of the Pod Pocket; and wherein the sight-line indicator is aligned with a striking axis of the mallet when installed.

* * * * *